US010340604B2

(12) United States Patent
Chistyakov et al.

(10) Patent No.: US 10,340,604 B2
(45) Date of Patent: Jul. 2, 2019

(54) METHOD OF FORMING BROAD RADIATION PATTERNS FOR SMALL-CELL BASE STATION ANTENNAS

(71) Applicant: Commscope Technologies, LLC, Hickory, NC (US)

(72) Inventors: Nikolay V. Chistyakov, Plano, TX (US); Scott L. Michaelis, Plano, TX (US)

(73) Assignee: CommScope Technologies, LLC, Hickory, NC (US)

( * ) Notice: Subject to any disclaimer, the term of this patent is extended or adjusted under 35 U.S.C. 154(b) by 921 days.

(21) Appl. No.: 14/526,177

(22) Filed: Oct. 28, 2014

(65) Prior Publication Data

US 2015/0303585 A1 Oct. 22, 2015

Related U.S. Application Data

(60) Provisional application No. 61/981,535, filed on Apr. 18, 2014.

(51) Int. Cl.
*H01Q 21/00* (2006.01)
*H01Q 1/24* (2006.01)
(Continued)

(52) U.S. Cl.
CPC ..... *H01Q 21/0006* (2013.01); *H01Q 1/246* (2013.01); *H01Q 3/30* (2013.01); *H01Q 21/205* (2013.01); *H01Q 21/29* (2013.01)

(58) Field of Classification Search
CPC .. H01Q 21/0006; H01Q 21/205; H01Q 21/29; H01Q 1/246; H01Q 3/30
See application file for complete search history.

(56) References Cited

U.S. PATENT DOCUMENTS 3,226,724 A 12/1965 Brueckmann
5,771,017 A 1/1998 James et al.
(Continued)

FOREIGN PATENT DOCUMENTS

DE 3433975 4/1985
WO WO 2011/120090 10/2011

OTHER PUBLICATIONS

PCT/US2015/024539 International Search Report dated Jul. 15, 2015.
(Continued)

*Primary Examiner* — Hai V Tran
*Assistant Examiner* — Michael M Bouizza
(74) *Attorney, Agent, or Firm* — Myers Bigel, P.A.

(57) ABSTRACT

A base station antenna system includes a plurality of sector antennas angularly spaced around a support structure at approximately equal azimuth angles. A feed network is coupled to the plurality of sector antennas and provides a common RF signal to the plurality of sector antennas and applies at least one phase difference to at least one sector antenna of the plurality of sector antennas. In one example, the base station antenna system includes first, second and third sector antennas angularly spaced at 120° intervals and the feed network applies a 120° phase difference to the second sector antenna and a 240° phase difference the third sector antenna. In another example, the base station antenna system includes first, second, third and fourth sector antennas angularly spaced at 90° intervals and the feed network applies a 180° phase difference to the second and fourth sector antennas.

21 Claims, 11 Drawing Sheets

(51) Int. Cl.

| | |
|---|---|
| ***H01Q 3/30*** | (2006.01) |
| ***H01Q 21/20*** | (2006.01) |
| ***H01Q 21/29*** | (2006.01) |

(56) References Cited

U.S. PATENT DOCUMENTS

| | | | | |
|---|---|---|---|---|
| 2011/0188418 | A1* | 8/2011 | Ylitalo | H01Q 3/30 370/310 |
| 2013/0201065 | A1* | 8/2013 | Parsche | H01Q 7/00 343/743 |
| 2013/0287144 | A1 | 10/2013 | Nicholas et al. | |

OTHER PUBLICATIONS

T. Rahim et al., "Effect of Directional Elements on the Directional Response of Circular Antenna Arrays", Iee Proc,; 129(1), 19-20 (1982).

T. Rahim, "Directional Pattern Synthesis in Circular Arrays of Directional Antennas", Internet: discovery.ucl.ac.uk; 1-228 (2015).

Fenby, R.G., "Limitations on Directional Patterns of Phase-compensated Circular Arrays", The Radio and Electr. Eng., 30(4), 206-20, (1965).

Notification Concerning Transmittal of International Preliminary Report on Patentability Corresponding to International Application No. PCT/US2015/024539; dated Oct. 27, 2016; 14 Pages.

* cited by examiner

D/λ = 1

D/λ = 2

D/λ = 3

D/λ = 4

In-phase feed (0, 0, 0, 0), D/λo=2.5 and Fmax/Fmin=1.5

F=Fmin

F=Fo

F=Fmax

Out of phase feed (0, 180, 0, 180), D/λo=2.5 and Fmax/Fmin=1.5

F=Fmin

F=Fo

F=Fmax

F=Fmax
(0, 180, 0, 180)

F=Fo
(0, 0, 0, 0)

F=Fmin
(0, 180, 0, 180)

METHOD OF FORMING BROAD RADIATION PATTERNS FOR SMALL-CELL BASE STATION ANTENNAS

This application claims priority benefit of U.S. Provisional Patent Application No. 61/981,535, filed on 18 Apr. 2014.

FIELD

The present invention is in the field of the wireless communications. More particularly, the invention is in the field of the technique of the radiation pattern control for antennas used in base stations for mobile wireless communications.

BACKGROUND

Wireless mobile voice and data communications have been achieved for some time now with macro cell base stations serving a large service area. Macro cells may be located on a dedicated tower or building top. Typically, each antenna serves one sector of an area surrounding the macro cell. Where more than one antenna is used for a given sector (e.g., receive diversity), antenna spacing may be adjusted for optimal spacing.

A newer trend involves adding small-cell base stations, especially in urban areas. These small cell stations are often used to increase capacity in an area already serviced by a macro cell. The equipment of the small-cell base stations is often installed on pre-existing objects of the city infrastructure. For example, small cell antennas may be mounted on a street utility pole using mounting structure. In such installations, antenna spacing is less readily adjustable, if at all.

It is often desired that the antenna system of the small cell uses a single transceiver coupled to multiple antennas, where the radiation patterns of the antennas are combined to form a quasi-omni directional radiation pattern for coverage of broad range of azimuth angles.

The antenna system located on a pole around a mounting structure may comprise a plurality of individual sector antennas (sometime called panel antennas) with main lobes oriented into different directions.

The individual antennas used in a small-cell antenna system are not necessarily designed for this purpose. For example, panel antennas designed for use in multi-sector base station applications may be used in the small-cell base station antenna system and configured into a quasi-omni single sector pattern. In the horizontal plane, the main lobe half-power beam-width of a sector antenna incorporated into the antenna system may be, for example, 60 degrees. In the real world, the beam-width of the sector antenna in use as well as the number of antennas placed on a pole may be not optimized specifically for creating a good quasi-omni radiation pattern. For example, the number of antennas may be dictated by various reasons—including economic reasons, and zoning regulations. As a result the radiation pattern of the small-cell station antenna system may be very far from optimal. To make the situation worse, the sector antennas may be mounted far from each other and the radiation pattern may have multiple maxima and nulls.

For example, assuming the sector antennas are identical, each antenna radiates the same power, and their phase centers are located on a circle diameter D, the overall radiation pattern of the antenna system will considerably depend on D; more precisely on D/λ. The series of radiation patterns shown in FIGS. 2 and 3 illustrate the effect of D/λ on radiation patterns. If $0<D/\lambda<1$ the radiation pattern changes only slightly with Dλ; for $D/\lambda>1$, the radiation pattern is impacted much more.

The radiation pattern depends on $D/\lambda=D*F/C$, where F is frequency and C is speed of light. Therefore, the combined radiation pattern of the sector antennas is affected equally by increasing D and increasing frequency.

The radiation patterns of the individual sector antennas partially overlap. At large values of D/λ, several nulls and maxima may exist in the overlapping area. The pole diameter and the size of the antenna mounting structure can be big D/λ and removing nulls and maxima may be impossible. However, the location of maxima and nulls in the overlapping area can be controlled by phases of signals feeding the sector antennas.

SUMMARY

The method proposed in the present inventions allows creating radiation patterns, though not quasi-omni directional, but still allowing coverage broad range of angles. In a multi-path urban environment covered by multiple macro-cell and small-cell base stations, a radiation pattern covering a broad range of aggregated azimuth angles at nearly constant radiation power and having few deep narrow nulls may be a better choice than a pattern with broad shallow nulls. Here, the power that differs from the maximum radiated power by less than about 3 dB is referred to as nearly constant.

Accordingly, one goal of the present invention is increasing a range of aggregated angles covered at nearly a constant radiation power by a small-cell antenna system—for short, increasing the coverage. For this reason the term broad or increased coverage will be used as a substitute for quasi-omni. The goal is achieved by phasing the sector antennas to create the maxima near the main lobes of sector antennas while placing the nulls, in the area between the main lobes.

In certain embodiments of the present invention, an out of phase feed of the neighboring antennas is employed to increase the coverage. In another embodiment an in-phase feed of the neighboring antennas is employed. In other embodiments, with sufficiently broad frequency bandwidth, unequal length of feeding cables is employed to implement transition from the in-phase feed at one frequency to the out of phase feed at another frequency, keeping broad coverage at all frequencies.

A base station antenna system according to one aspect of the present invention is capable of being mounted on a support structure, such as a utility pole. A plurality of sector antennas are angularly spaced around the support structure at approximately equal azimuth angles. A feed network is coupled to the plurality of sector antennas and provides a common RF signal to the plurality of sector antennas and applies at least one phase difference to at least one sector antenna of the plurality of sector antennas.

In one example, the base station antenna system includes first, second and third sector antennas angularly spaced at 120° intervals and the feed network applies a 120° phase difference to the second sector antenna and a 240° phase difference the third sector antenna.

In another example, the base station antenna system includes first, second, third and fourth sector antennas angularly spaced at 90° intervals and the feed network applies a 180° phase difference to the second and fourth sector antennas.

In one example, the feed network includes at least one out-of-phase power splitter to impart the at least one phase difference. In another example, the feed network includes cables having different lengths, where the difference in lengths is selected to impart the at least one phase difference. In another example, the feed network includes phase shifter circuitry to impart the at least one phase difference.

In another aspect of the invention, the feed network may be adapted to work over a very wide band of operation, where the sector antennas have a range of frequency operation including a upper frequency, a lower frequency, and a middle frequency. Cable lengths in the feed network may be selected such that the antennas are fed in-phase at the middle frequency and out-of-phase at the upper frequency and the lower frequency. Alternatively, cable lengths in the feed network may be selected such that the antennas are fed out-of-phase at the middle frequency and in-phase at the upper frequency and the lower frequency.

The base station antenna system may be extended to any N number of sector antennas wherein the feed network comprises an N-way power splitter. The power splitter may be an in-phase power splitter or an out-of-phase power splitter. The power splitter may comprise a plurality of two-way power splitters cascaded in a network.

DETAILED DESCRIPTION OF EMBODIMENTS

The following is a detailed description of the invention depicted in the accompanying drawings. The amount of detail offered is not intended to limit the anticipated variations of embodiments; but, on the contrary, the intention is to cover all modifications, equivalents, and alternatives falling within the spirit and scope of the present invention as defined by the appended claims.

Figure 1:
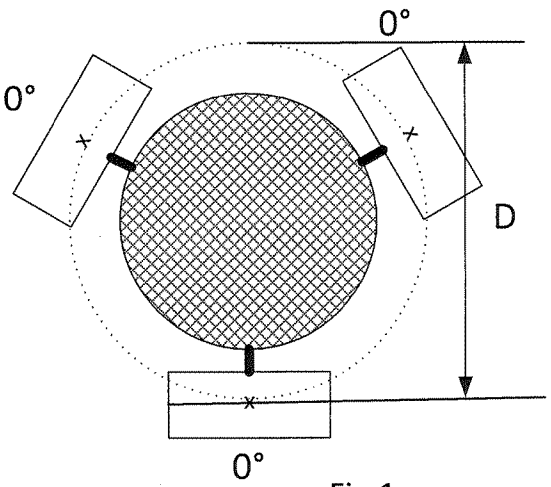
Fig.1 (Prior Art)
FIG. 1 illustrates locations of phase centers of individual sector antennas of a known tri-sector antenna system mounted on a utility pole.
Figure 3A:
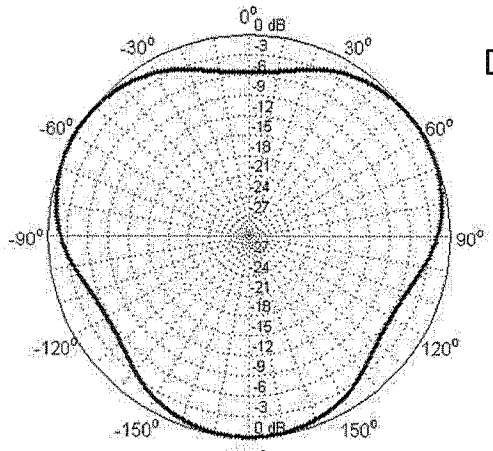
FIGS. 3A-3D illustrate the resultant radiation patterns of a tri-sector antenna system with increasing DA.
Figure 3B:
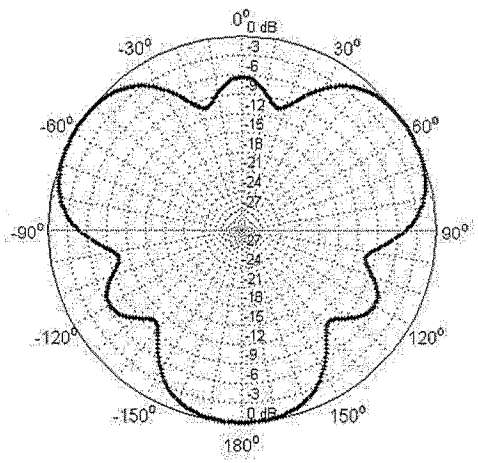
Figure 3C:
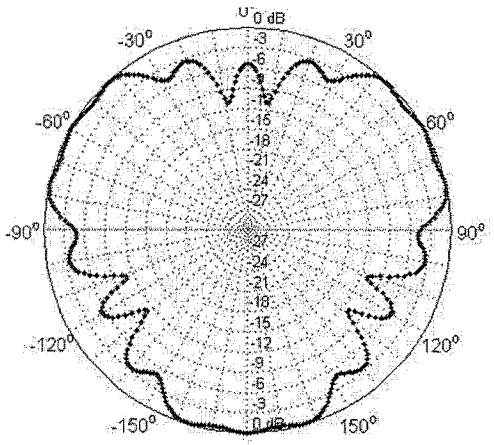
Figure 3D:
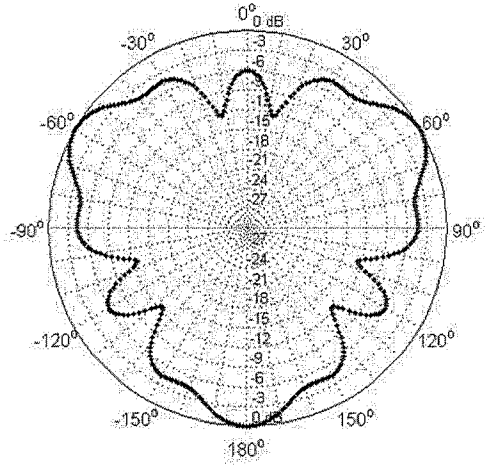

Referring to FIG. 1, a looking-from-above view of a known tri-sector system with three sector antennas attached around a pole is illustrated. The sector antennas are fed with a common signal to create a quasi-omni directional radiation pattern. The phase centers are designated by an "x" in each sector antenna, and a circle including each of the phase centers has a diameter "D". In such known systems, the antennas are fed in-phase (e.g., as phase differences of 0, 0, 0 degrees). The signals are obtained from a single transceiver using a three-way in-phase power splitter. As illustrated in FIGS. 3A-3D (described below), a drawback of using three antennas configured as a quasi-omni system is limited angles of coverage.

Figure 2A:
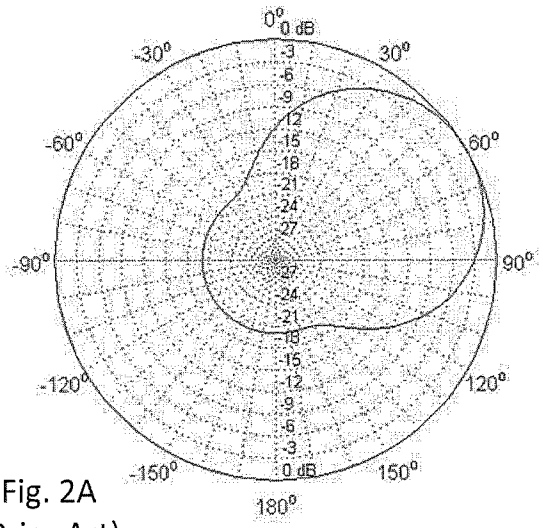
Fig. 2A (Prior Art)
FIG. 2A illustrates an example of the radiation pattern of a single sector antenna according to the system of FIG. 1.
Figure 2B:
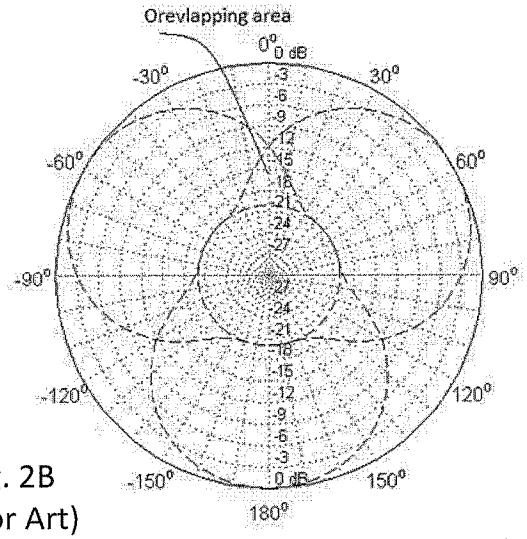
Fig. 2B (Prior Art)
FIG. 2B illustrates an example of the radiation pattern of the main lobes of a tri-sector antenna system according to the system of FIG. 1.

FIG. 2A illustrates a radiation pattern for one sector antenna. FIG. 2B illustrates radiation patterns for three sector antennas arranged as illustrated in FIG. 1. In FIG. 2B, the sector antennas are configured to operate as three independent sectors, and are not being fed by a common signal. Accordingly, there is little interaction between the radiation patterns.

Referring to FIG. 3A-3D, radiation patterns are illustrated for the three-antenna example as illustrated in FIG. 1, with the sector antennas being fed by a common signal and operating in a quasi-omni mode. The antennas are fed with no relative delay between the three antennas (referred to herein as "in phase"). FIGS. 3A, 3B, 3C and 3D illustrate radiation patterns for D/λ=1, 2, 3, 4, respectively. For example, for the case of D/λ=2 (FIG. 3B) the aggregated angles (with less than 3 dB power drop) total at 154 degrees, which is less than the 180° that would be expected for three, 60° 3 dB antennas. Wide, though not deep nulls, can be seen in the picture.

Figure 4:
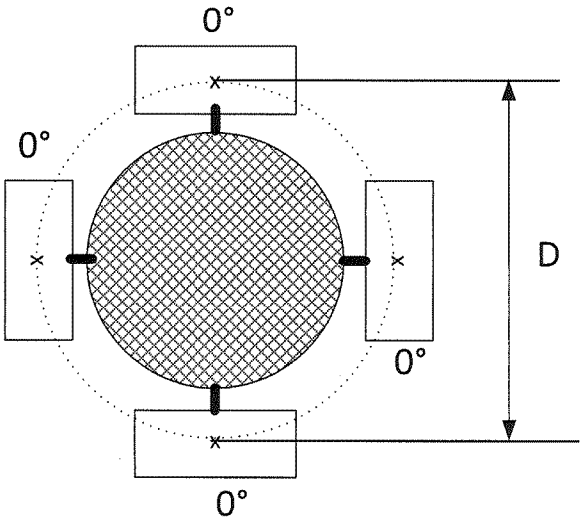
FIG. 4 illustrates locations of phase centers of individual sector antennas of a four sector antenna system mounted on a utility pole having in-phase feed.
Figure 6A:
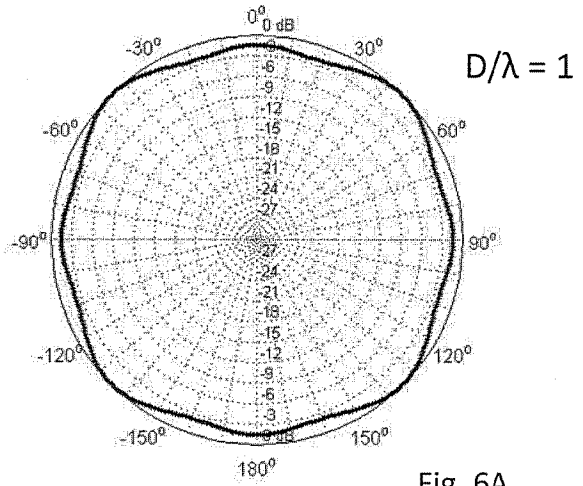
FIGS. 6A-6D illustrate the resultant radiation patterns of a four sector antenna system having in-phase feed with increasing D/λ.
Figure 6B:
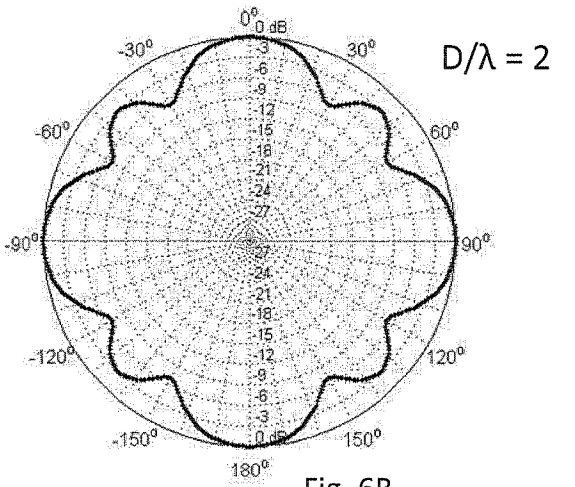
Figure 6C:
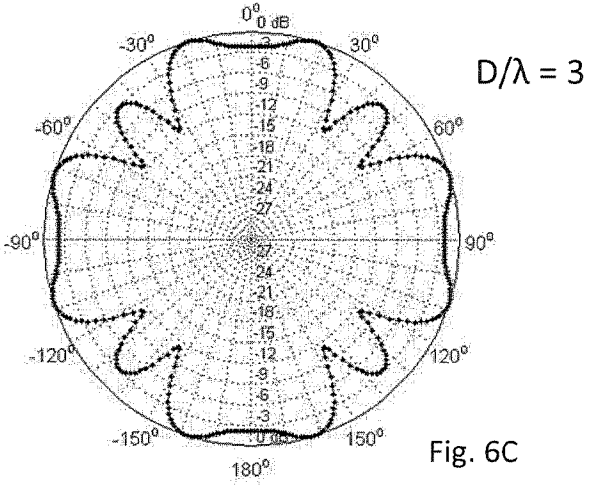
Figure 6D:
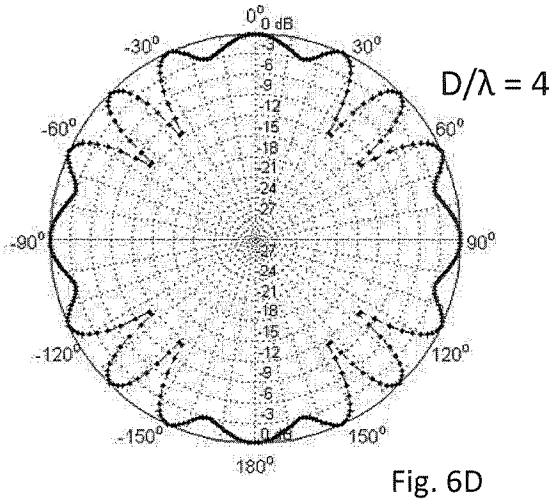

In an attempt to improve the radiation patterns of a three sector antenna quasi-omni system, a fourth antenna may be added. Referring to FIG. 4, a looking-from-above view of a four sector system with four sector antennas attached around a pole is illustrated. The sector antennas are fed with a common signal to create a quasi-omni directional radiation pattern. As with the FIG. 1, the phase centers are designated by an "x" in each sector antenna, and a circle including each of the phase centers has a diameter "D". In the example illustrated in FIG. 4, the antennas are fed in-phase (relative phase delays of 0, 0, 0, 0 degrees). The signals are obtained from a single transceiver using a four way in-phase power splitter.

Figure 5A:
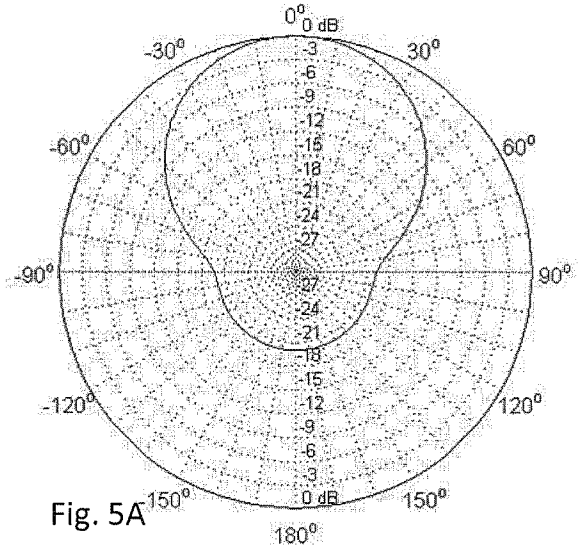
FIG. 5A illustrates an example of the radiation pattern of a single sector antenna according to the system of FIG. 4.
Figure 5B:
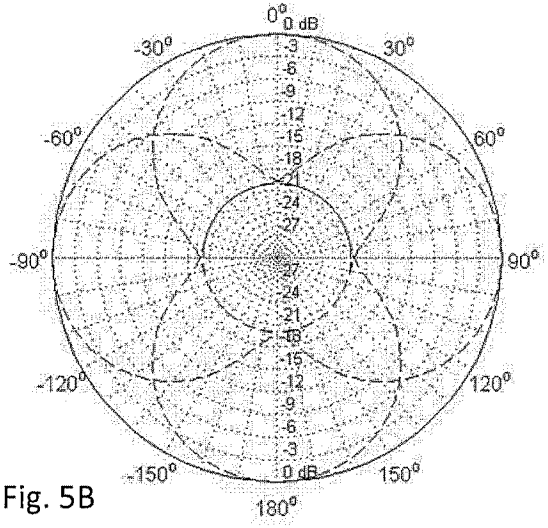
FIG. 5B illustrates an example of the radiation pattern of the main lobes a four sector antenna system according to the system of FIG. 4.

FIG. 5A illustrates a radiation pattern for one sector antenna of the example illustrated in FIG. 4. FIG. 5B illustrates radiation patterns for four sector antennas arranged as illustrated in FIG. 4. In FIG. 5B, the sector antennas are configured to operate as four independent sectors, and are not being fed by a common signal. Accordingly, there is little interaction between the radiation patterns.

FIGS. 6A-6D illustrate that, when fed as a quasi-omni system, simply adding a fourth antenna instead of using three antennas may not provide a sufficient improvement in the resultant radiation pattern. As illustrated in FIG. 4, the sector antennas are fed by a common signal and operate in a quasi-omni mode. The antennas are fed in phase. The FIGS. 6A, 6B, 6C and 6D illustrate radiation patterns for D/λ=1, 2, 3, 4, respectively. For example, for the case of D/λ=2, aggregated angles (where the radiated power drops 3 dB or less) are 160 degrees instead of the 240 degrees that one would expect from combining four 60 degree antennas.

Figure 7:
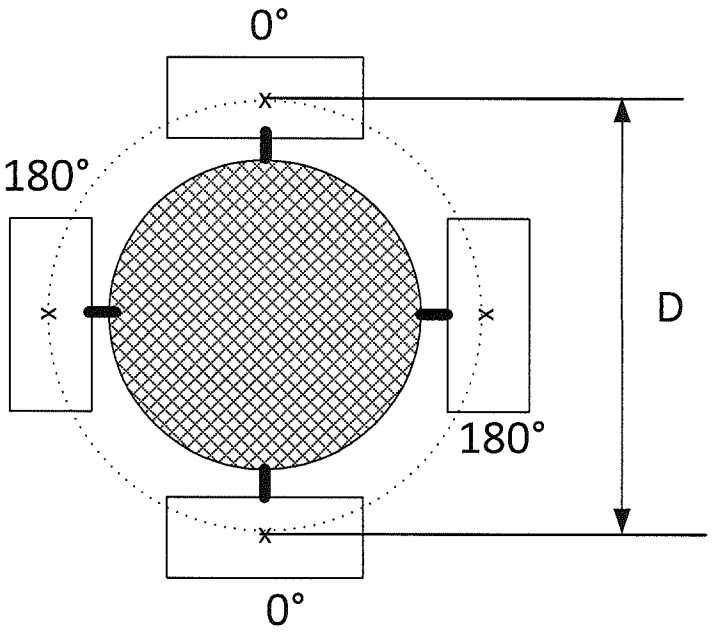
FIG. 7 illustrates locations of phase centers of individual sector antennas of a four sector antenna system mounted on a utility pole having an out of phase feed.

FIG. 7 illustrates one example of the present invention comprising four panel antennas being fed out of phase with respect to neighboring antennas. Referring to FIG. 7, a looking-from-above view of a four sector system with four sector antennas attached around a pole is illustrated. The sector antennas are fed with a common signal to create a quasi-omni directional radiation pattern. The phase centers are designated by an "x" in each sector antenna, and a circle including each of the phase centers has a diameter "D". In the example illustrated in FIG. 7, the antennas are fed out of phase with neighboring antennas (phase difference of 0, 180, 0, 180 degrees).

The antenna system of FIG. 7 results in increased coverage relative to the in-phase fed example of FIG. 4. FIGS. 8A-8D illustrate radiation patterns for D/λ=1, 2, 3, 4, respectively for the example of FIG. 7. These patterns show that the radiation pattern is considerably improved for certain ratios of D to λ (FIGS. 8B, 8C) if out of phase feed for neighboring antennas is used. For example, for D/λ=2 (FIG. 8B) aggregated angles of less than 3 dB of power drop are 285 degrees. The range of covered angles increases 1.8 times comparing with the in-phase feed, and it is 45 degrees more than expected 240 degrees (4 antennas×60° 3 dB beamwidth).

This improvement is because changing the phase of the signal in one of neighboring antennas from 0 to 180 degrees interchanges the positions of nulls and maxima. The null that was near the main lobe, decreasing its beam-width, will be turned to a maximum increasing the main lobe beam-width. The price for this improvement is nulls between the main lobes because deep, albeit narrow. However, narrow nulls may not be disadvantageous when the user is located in the multi-path area covered by both a macro cell and a quasi-omni small cell configured as shown in FIG. 7.

Figure 8A:
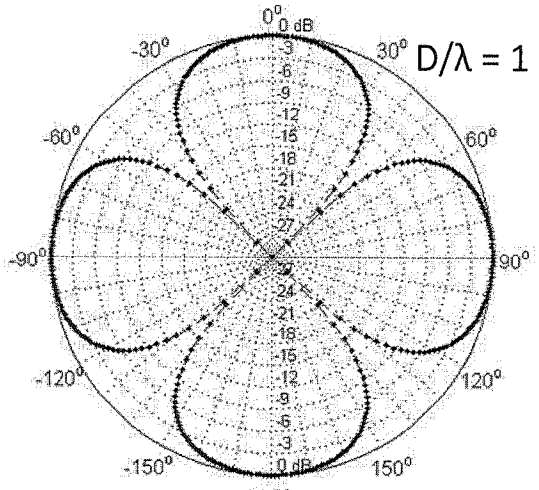
FIGS. 8A-8D illustrate the resultant radiation patterns of a four sector antenna system having an out of phase feed with increasing D/λ.
Figure 8B:
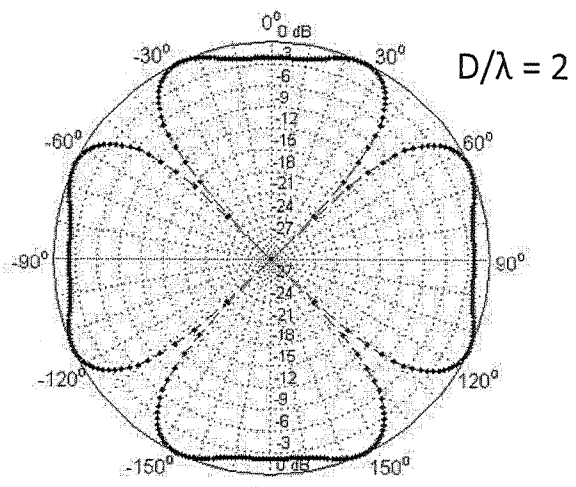
Figure 8C:
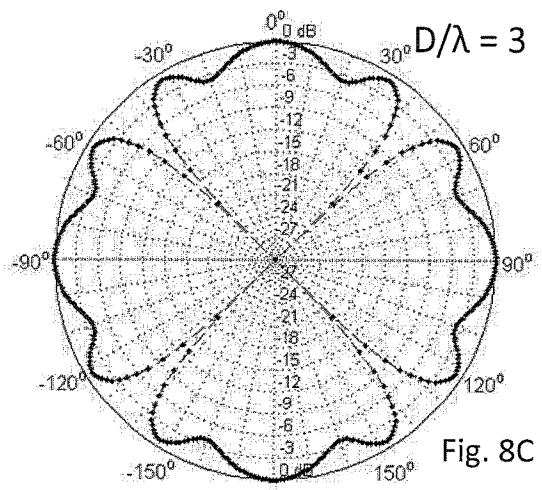
Figure 8D:
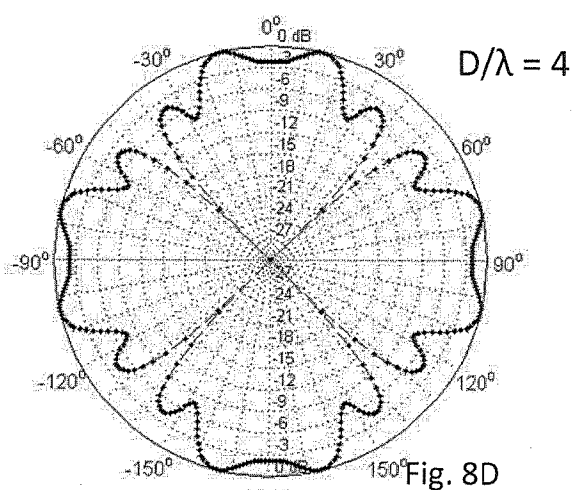

FIGS. 8A and 8D shows that at D/λ=1 and D/λ=4 the main beam-width actually decreases, comparing with in-phase feed. This decrease occurs because the maximum that was near the main lobe is turned to null decreasing the beam-width. Therefore, at these D/λ ratios the in-phase feed is preferable.

If the operating frequency band is narrow, then circuits realizing either the in-phase or the out of phase feed should be used in the antenna system, depending on which one provides the wider beam-width at a given ratio of D/λo, where λo is the free-space wave length at a middle frequency Fo. For example, if the operating band is relatively narrow and D/λo equals about 2, out of phase as feeding is preferable. Circuits for implementing out of phase feeding are described below with respect to FIGS. 9A-9D. If the operating band is relatively narrow and D/λo equals about 1, in phase feeding is preferable.

Figure 9D:
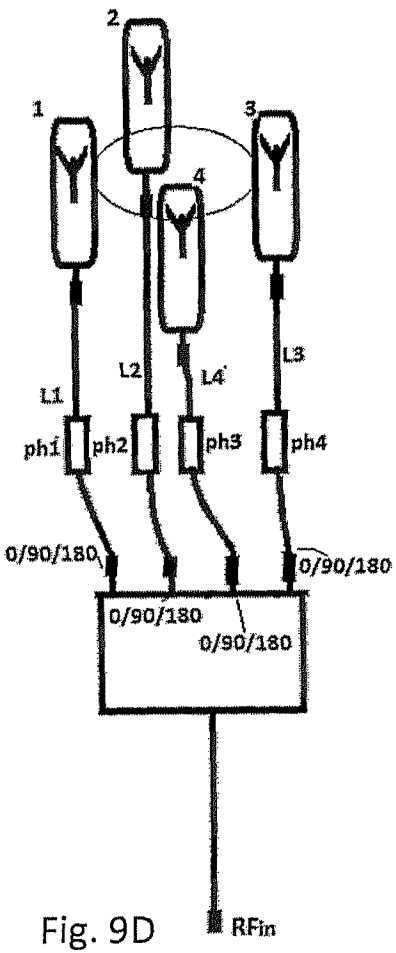
FIGS. 9A-9D illustrate embodiments of feeding circuits for realizing radiation patterns with increased coverage.
Figure 9C:
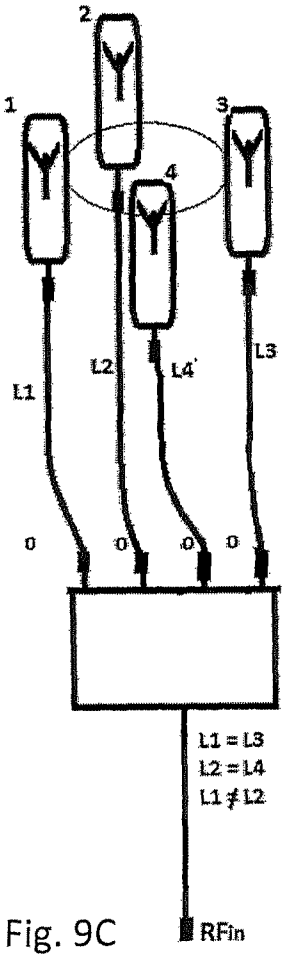
Figure 9B:
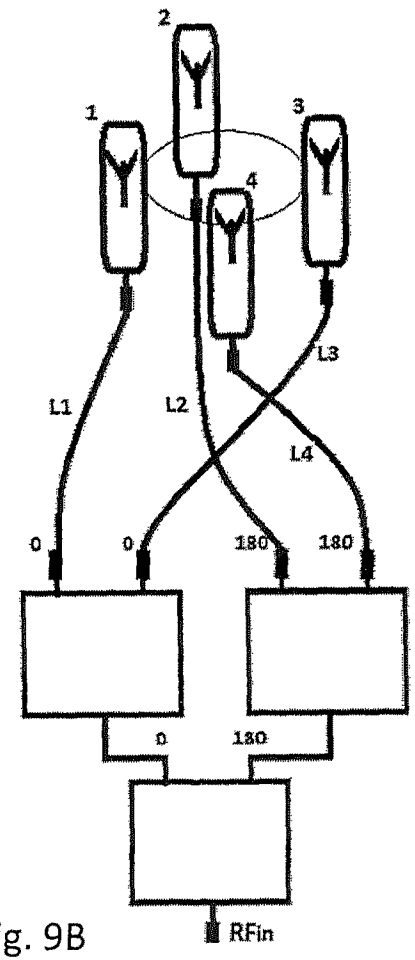
Figure 9A:
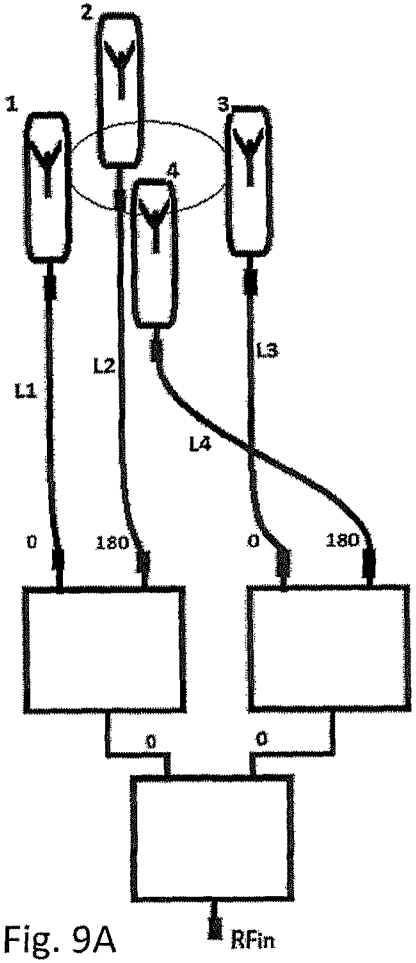

FIG. 9A and FIG. 9B illustrate possible embodiments of the circuits realizing output out of phase signals (0, 180, 0, 180) in a frequency band. These circuits may comprise broadband 2-way in-phase and 2-way out of phase power splitters. Circuits employing 90 degree hybrids (not shown) can be also used for creating 0, 90, and 180 degrees in a broad frequency band.

FIG. 9C illustrates an embodiment of another circuit realizing out of phase signals. The circuit may be implemented using a 4-way in-phase power splitter and 2 pairs of cables with equal lengths in the pair, but different lengths between pairs, so that the phase difference is near 180 degrees at the operating frequency. For example, one pair of cables provides phases (ψ, ψ) and the other pair of cables provides phases (ψ+180, ψ+180) at the operating frequency. The neighboring antennas may be fed by the out of phase signals (ψ, ψ+180, ψ, ψ+180) by connecting each cable to the appropriate antenna.

FIG. 9D illustrates an embodiment of the present invention that is an extension of the embodiment in FIG. 9C. The phases at the outputs of the 4-way power splitter may be either 0, or 90, or 180 degrees, which is realizable in broad frequency band at RF frequencies. This embodiment uses phase correcting circuits: ph1, ph2, ph3, and ph4 added to the cables. The purpose of these phase correcting circuits is to allow more flexible adjustment of phases at specified frequencies in order to create a radiation pattern with broad coverage across a broad frequency band. The phase correcting circuits can be realized, for example, with striplines or microstrips printed on a printed circuit board.

However, as noted above, D/λ varies with frequency, and the operating frequency band of wideband elements may indicate a need for in phase feeding at certain frequencies and out of phase feeding at other frequencies. For example, if the operating frequency band is wide and the in-phase feed provides a wider coverage for Fo, (the frequency in the middle of the operating band) it may be that out of phase feed provides a wider coverage for Fmin and Fmax (the minimum and maximum frequencies of the operating band, respectively). In this case circuits should be added that allow transition from the in-phase to the out of phase feed. These circuits could be just cables of unequal length.

Figure 10A:
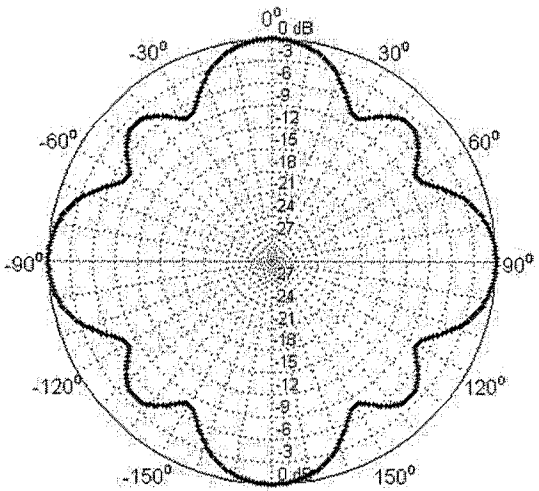
FIGS. 10A-10C illustrate the effect of varying the frequency of a signal on the radiation patterns of a four sector antenna system having an in-phase feed.
Figure 10B:
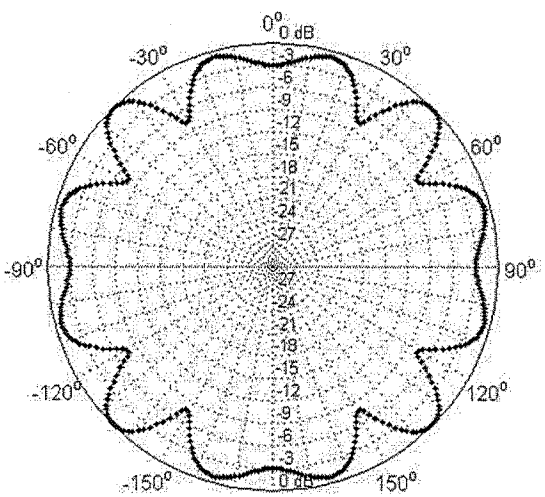
Figure 10C:
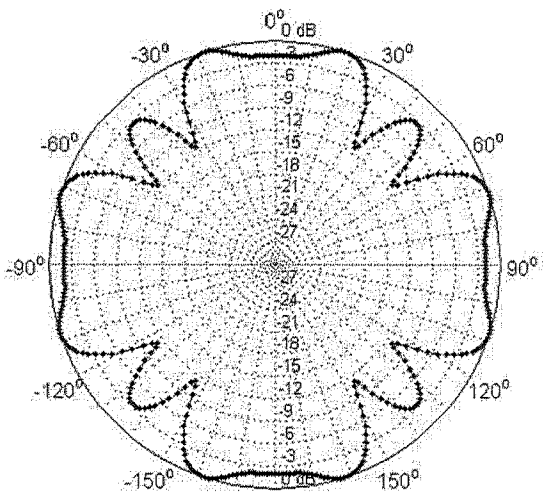
Figure 11A:
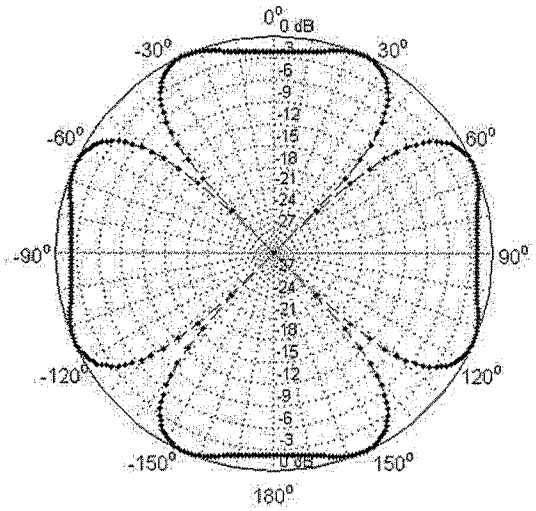
FIGS. 11A-11C illustrate the effect of varying the frequency of a signal on the radiation patterns of a four sector antenna system having an out of phase feed.
Figure 11B:
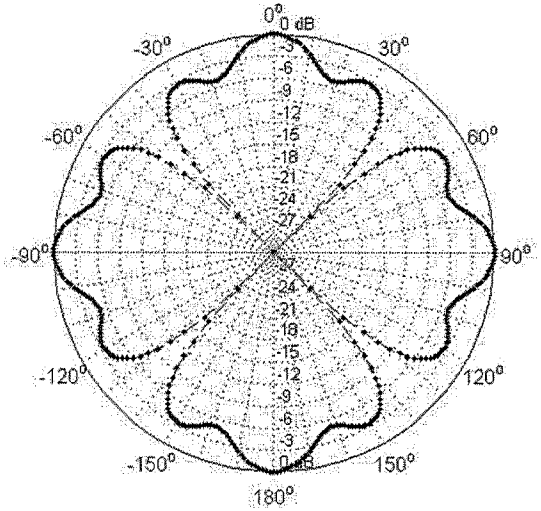
Figure 11C:
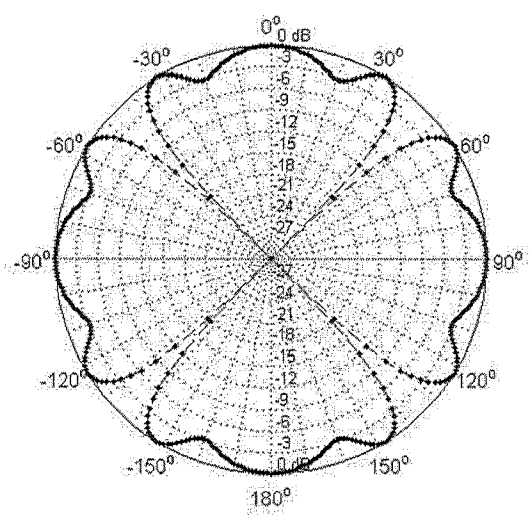
Figure 12C:
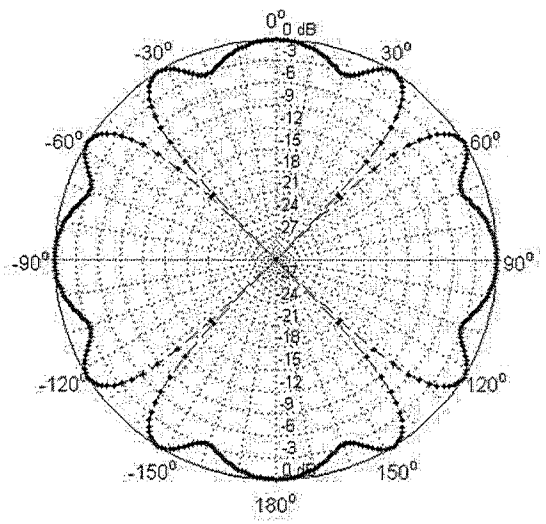
FIGS. 12A-12C illustrate the effect of varying the frequency of a signal on the radiation patterns of a four sector antenna system having an out of phase feed and different length feed cables.
Figure 12B:
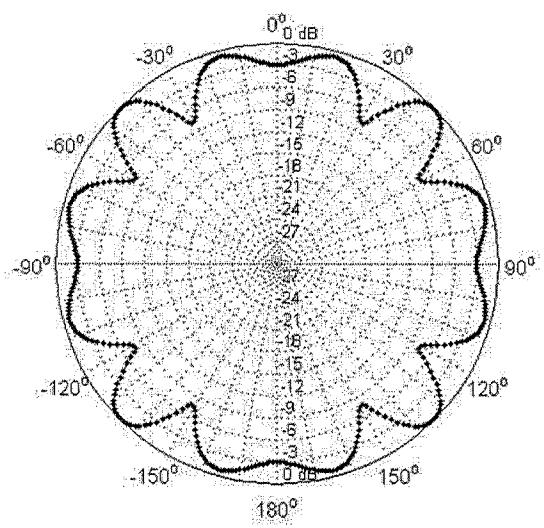
Figure 12A:
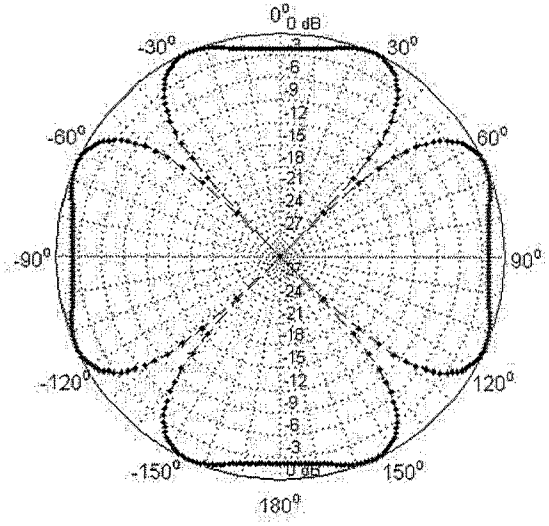

FIGS. 10, 11 and 12 illustrate a scenario with ratio of D/λ as big as 2.5 and a wide operating frequency band Fmax/Fmin=1.5, where Fmax and Fmin are maximum and minimum operating frequencies, respectively. As it can be seen from the figures, the coverage depends on frequency.

FIG. 10 illustrates a broad coverage at the middle frequency Fo and narrow coverage at Fmin and Fmax when and in-phase feed (0, 0, 0, 0) is used. FIG. 11 illustrates the broad coverage at Fmin and Fmax and narrow coverage at Fo when using the out of phase feed (0, 180, 0, 180).

FIG. 12 illustrates an "optimized" radiation pattern with broad coverage over a wide band of frequencies. This result obtained by using 2 pairs of cables (see FIG. 8C) with equal lengths in the pair, but different lengths between pairs, so that the phase difference is near 180 degrees at Fmin and Fmax and near 0 degrees at Fo. This results in the antenna phasing being frequency dependent, that is, out of phase (0, 180, 0, 180 degrees) at Fmin and Fmax, and in phase (0, 0, 0, 0 degrees) at Fo.

The required cable length difference can be determined using the formula (1):

$$\Psi=-360*\tau*F; \quad (1)$$

Here Ψ degrees is the phase added by a cable with group delay τ at frequency F. It could be shown that two cables with different length will have 0 degrees phase difference at Fo and 180 degrees, at Fmin and Fmax only if:

$$N=(F\max/F\min+1)/(F\max/F\min-1); \quad (2)$$

Here N is a natural number.

Figure 13:
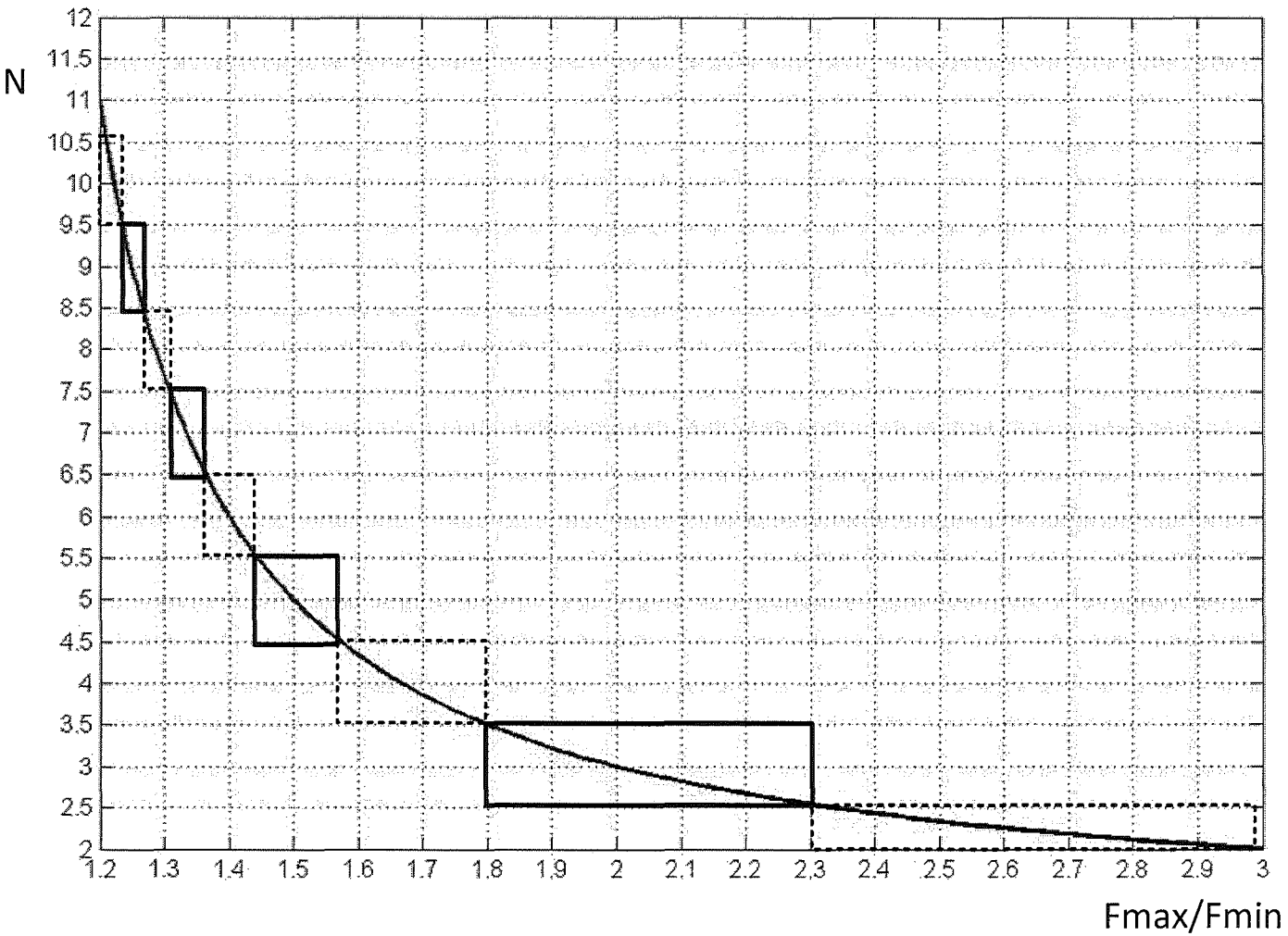
FIG. 13 illustrates a method of calculating cables length difference according to the embodiments illustrated in FIG. 9C.

For odd N the out of phase 4-way divider (see FIGS. 8A, 8B) should be used with pairs of unequal length cables; for even N the in-phase 4-way divider illustrated in FIG. 8C should be used with pairs of unequal length cables. If N is not natural, the required phases will be realized only to some degree of accuracy. The closer N is to a natural number, the better will be the accuracy. FIG. 13 details the procedure of determining the length difference of cables used to create a broad coverage radiation pattern in the antenna system used for a small cell.

N is plotted as a relative to Fmax/Fmin in FIG. 13. Ideally, N should be a natural number. If not natural, N is taken from the boxes around natural N. If N is taken from a vicinity of an odd number (boxes with solid lines), a 4-way out of phase power divider should be used, see FIGS. 8A, 8B. If N is taken from a vicinity of an even number (boxes with dashed lines), a 4-way in-phase power divider should be used, see FIG. 8C. The length difference of two cables providing phase difference 0 degrees at Fo and 180 degrees at Fmin and Fmax may be determined from the equation: $\Delta L = N^* \lambda m$, where $\Delta L$-length difference, and $\lambda m$ is the wavelength in the cable at the middle frequency Fo.

The method of increasing coverage is explained using a 4-antenna system only as an illustrative example. This method is not limited by the case of 4 antennas. It may readily be adapted for any even number: (2, 4, 6, 8 . . . ) of sector antennas in the micro-cell antenna system attached around a pole. The neighboring antennas may be fed out of phase at some frequencies and in-phase at other frequencies to provide broad angle coverage at broad frequency band. The method can be also extended on an odd number of antennas (3, 5, 7 . . . ). In this case the out of phase feeding of the neighboring antennas can be realized only approximately. For example, in case of 3 antennas the phases 0, 120, 240 degrees will be an approximation of the out of phase feeding, provided the phase difference between the neighbor antennas is constant.

For N antennas in the antenna system, where N is an odd number, the phases can be taken from the table

| | N | | | | | | | | | |
|---|---|---|---|---|---|---|---|---|---|---|
| K | 3/1 | 3/2 | 5/1 | 5/2 | 7/1 | 7/2 | 9/1 | 9/2 | 11/1 | 11/2 |
| 1 | 0 | 0 | 0 | 0 | 0 | 0 | 0 | 0 | 0 | 0 |
| 2 | 120 | 240 | 144 | 216 | 154.3 | 205.7 | 160 | 200 | 163.6 | 196.4 |
| 3 | 240 | 120 | 288 | 72 | 308.6 | 51.4 | 320 | 40 | 327.3 | 32.7 |
| 4 | | | 72 | 288 | 102.9 | 617.1 | 120 | 240 | 130.9 | 229.1 |
| 5 | | | 216 | 144 | 257.1 | 102.9 | 280 | 80 | 294.5 | 65.5 |
| 6 | | | | | 51.4 | 308.6 | 80 | 280 | 98.2 | 261.8 |
| 7 | | | | | 205.7 | 154.3 | 240 | 120 | 261.8 | 98.2 |
| 8 | | | | | | | 40 | 320 | 65.5 | 294.5 |
| 9 | | | | | | | 200 | 160 | 229.1 | 130.9 |
| 10 | | | | | | | | | 32.7 | 327.3 |
| 11 | | | | | | | | | 196.4 | 163.6 |

K denotes the K-th antenna in the circular array.

Two columns of phases are given for each N (e.g. 3/1 and 3/2 or 5/1 and 5/2 or 7/1 and 7/2). The values of phases in each column, for example, in 5/1 and in 5/2 give similar approximations of out of phase feed of neighboring antennas. The difference is in the direction of counting phases—clockwise or counterclockwise. Phases for N not included in the table can be calculated.

The phase of the k-th element in the column designated as N/1 is $$180 \cdot \frac{N-1}{N} \cdot k, \text{ deg}$$

The phase of the k-th element in the column designated as N/2 is $$180 \cdot \frac{N+1}{N} \cdot k, \text{ deg}$$

where k=0, 1, 2 . . . N−1.

Unequal lengths of feeding cables can be used similarly to the case of 4 antennas described above in more detail.

The base station antenna systems described herein and/or shown in the drawings are presented by way of example only and are not limiting as to the scope of the invention. Unless otherwise specifically stated, individual aspects and components of the antennas and feed network may be modified, or may have been substituted therefore known equivalents, or as yet unknown substitutes such as may be developed in the future or such as may be found to be acceptable substitutes in the future.

What is claimed is:

1. A base station antenna system, comprising:

a plurality of sector antennas angularly spaced around a support structure; and a feed network coupled to the plurality of sector antennas;

wherein the feed network is configured to split a common RF signal into a plurality of input signals that are provided to the plurality of sector antennas, respectively, and is further configured to provide the plurality of input signals to the plurality of sector antennas, respectively, by generating a phase difference between a first and a second one of the plurality of input signals;

wherein the phase difference is based on a ratio $D/\lambda$, such that D is a diameter of a circle defined by a plurality of antenna phase center points for the plurality of sector antennas, respectively, and $\lambda$ is a wavelength of a signal having a frequency within a range of frequency operation of the plurality of sector antennas; and wherein the phase difference is configured to create maxima near main lobes of a radiation pattern generated by the plurality of sector antennas while creating nulls in areas of the radiation pattern between the main lobes.

2. The base station antenna system of claim 1, wherein the plurality of sector antennas comprises first, second and third sector antennas angularly spaced at 120° intervals;

wherein the phase difference comprises a plurality of phase differences between ones of the plurality of input signals;

wherein the plurality of input signals comprises the first, the second, and a third one of the plurality of input signals that are provided to the first, the second, and the third, sector antennas, respectively; and wherein the plurality of phase differences comprise a 120° phase difference between the first and the second one of the plurality of input signals and a 240° phase difference between the first and a third one of the plurality of input signals.

3. The base station antenna system of claim 1, wherein the plurality of sector antennas comprises first, second, third and fourth sector antennas angularly spaced at 90° intervals;

wherein the phase difference comprises a plurality of phase differences between ones of the plurality of input signals;

wherein the plurality of input signals comprises the first, the second, a third, and a fourth one of the plurality of input signals that are provided to the second, the fourth, the first, and the third sector antennas, respectively; and and wherein the phase difference comprises a 180° phase difference.

4. The base station antenna system of claim 1, wherein the feed network comprises at least one out-of-phase power splitter to generate the phase difference.

5. The base station antenna system of claim 1, wherein the feed network comprises a first cable having a first length coupled to a first one of the plurality of sector antennas and a second cable having a second length coupled to a second one of the plurality of sector antennas, wherein the first and second lengths are selected to generate the phase difference.

6. The base station antenna system of claim 1, wherein the feed network is further configured to provide the plurality of input signals to the plurality of sector antennas, respectively, by generating the phase difference between the first and the second one of the plurality of input signals based on ratios D/λup, D/λmid, and D/λlow;

wherein the plurality of sector antennas comprises first, second, third and fourth sector antennas angularly spaced at 90° intervals; and wherein the first and third sector antennas are coupled to a power splitter by cables having a first length and the second and fourth sector antennas are coupled to the power splitter by cables having a second length, the first length being different from the second length;

wherein the range of frequency operation of the plurality of sector antennas comprises an upper frequency (Fup), a lower frequency (Flow), and a middle frequency (Fmid); and wherein λup=Fup/C, where C is a speed of light, λmid=Fmid/C, and λlow=Flow/C.

7. The base station antenna system of claim 6, wherein the difference between the first length and the second length is selected to generate the phase difference of about 180° at the lower and upper frequencies and of about 0° degrees at the middle frequency.

8. The base station antenna system of claim 6, wherein the difference between the first length is selected to generate the phase difference of about 0° at the lower and upper frequencies and of about 180° at the middle frequency.

9. The base station antenna system of claim 6, wherein the power splitter comprises one of: a four-way in-phase power splitter; a four-way out-of-phase power splitter, and a network of two way in-phase and out-of-phase power splitters.

10. The base station antenna system of claim 1, wherein the feed network is further configured to provide the plurality of input signals to the plurality of sector antennas, respectively, by generating the phase difference between the first and the second one of the plurality of input signals based on ratios D/λup, D/λmid, and D/λlow;

wherein the plurality of sector antennas comprises first, second, third and fourth sector antennas angularly spaced at 90° intervals; and wherein the first second, third and fourth sector antennas are coupled to a power splitter by cables having equal lengths, the feed network further comprising phase shifter circuitry;

wherein the range of frequency operation of the plurality of sector antennas comprises an upper frequency (Fup), a lower frequency (Flow), and a middle frequency (Fmid); and wherein λup=Fup/C, where C is a speed of light, λmid=Fmid/C, and λlow=Flow/C.

11. The base station antenna system of claim 10, wherein the phase shifter circuitry is configured to generate the phase difference of about 180° at the lower and upper frequencies and of about 0° degrees at the middle frequency.

12. The base station antenna system of claim 10, wherein the phase shifter circuitry is configured to generate the phase difference of about 0° at the lower and upper frequencies and of about 180° at the middle frequency.

13. The base station antenna system of claim 1 wherein the plurality of sector antennas comprises N sector antennas and wherein the feed network comprises an N-way power splitter.

14. A base station antenna system, comprising:

first, second, third and fourth sector antennas angularly spaced around a support structure at approximately 90° intervals; and a feed network comprising at least one power splitter and first, second, third and fourth cables coupling the at least one power splitter to the first, second, third and fourth sector antennas, respectively;

wherein the feed network is configured to split a common RF signal into first, second, third, and fourth input signals that are provided to the first, second, third and fourth sector antennas, respectively, and is further configured to provide the first, second, third, and fourth input signals to the first, second, third, and fourth sector antennas, respectively, by generating a phase difference between the second and the fourth input signals;

wherein the phase difference is based on a ratio D/λ, such that D is a diameter of a circle defined by a plurality of antenna phase center points for the plurality of sector antennas, respectively, and λ is a wavelength of a signal having a frequency within a range of frequency operation of the plurality of sector antennas; and wherein the phase difference is configured to increase a beam width of main lobes of a radiation pattern generated by the first, second, third, and fourth sector antennas while deepening nulls in areas of the radiation pattern between the main lobes as compared to a radiation pattern generated by the first, second, third, and fourth sector antennas without the phase difference.

15. The base station antenna system of claim 14, wherein the phase difference comprises a 180° phase difference.

16. The base station antenna system of claim 14, wherein the feed network comprises at least one out-of-phase power splitter to generate the phase difference.

17. The base station antenna system of claim 14, wherein the first and third cables have a first length and the second and fourth cables have a second length, wherein the first and second lengths are selected to generate the phase difference.

18. The base station antenna system of claim 17, wherein the feed network is further configured to provide the first, second, third, and fourth input signals to the first, second, third, and fourth sector antennas, respectively, by generating the phase difference between the second and the fourth input signals based on ratios D/λup, D/λmid, and D/λlow;

wherein the range of frequency operation of the first, second, third, and fourth sector antennas comprises an upper frequency (Fup), a lower frequency (Flow), and a middle frequency (Fmid);

wherein the difference between the first length and the second length is selected to generate the phase difference of about 180° at the lower and upper frequencies of about 0° degrees at the middle frequency; and wherein λup=Fup/C, where C is a speed of light, λmid=Fmid/C, and λlow=Flow/C.

19. The base station antenna system of claim 17, wherein the feed network is further configured to provide the first, second, third, and fourth input signals to the first, second, third, and fourth sector antennas, respectively, by generating the phase difference between the second and the fourth input signals based on ratios D/λup, D/λmid, and D/λlow;

wherein the range of frequency operation of the first, second, third, and fourth sector antennas comprises an upper frequency (Fup), a lower frequency (Flow), and a middle frequency (Fmid);

wherein the difference between the first length and the second length is selected to generate the phase difference of about 0° at the lower and upper frequencies and of about 180° at the middle frequency; and wherein λup=Fup/C, where C is a speed of light, λmid=Fmid/C, and λlow=Flow/C.

20. The base station antenna system of claim 14, wherein the at least one power splitter comprises one of: a four-way in-phase power splitter; a four-way out-of-phase power splitter, and a network of two way in-phase and out-of-phase power splitters.

21. A base station antenna system, comprising:

a plurality of sector antennas angularly spaced around a support structure; and a feed network coupled to the plurality of sector antennas; wherein the feed network is configured to split a common RF signal into a plurality of input signals that are provided to the plurality of sector antennas, respectively, and is further configured to provide the plurality of input signals to the plurality of sector antennas, respectively, by generating a phase difference between a first and a second one of the plurality of input signals;

wherein the phase difference is based on a ratio D/λ, such that D is a diameter of a circle defined by a plurality of antenna phase center points for the plurality of sector antennas, respectively, and λ is a wavelength of a signal having a frequency within a range of frequency operation of the plurality of sector antennas; and wherein the phase difference is configured to increase the 3 dB azimuth beam width of main lobes of a radiation pattern of the plurality of sector antennas while deepening nulls between the main lobes of the radiation pattern.

* * * * *